US008640334B2

(12) United States Patent
Vukovich et al.

(10) Patent No.: US 8,640,334 B2
(45) Date of Patent: Feb. 4, 2014

(54) METHOD OF SETTING LASH IN A CAM PHASER

(75) Inventors: William P. Vukovich, Wyoming, MI (US); Nick John Hendriksma, Grand Rapids, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/471,976

(22) Filed: May 15, 2012

(65) Prior Publication Data

US 2012/0317807 A1 Dec. 20, 2012

Related U.S. Application Data

(60) Provisional application No. 61/498,898, filed on Jun. 20, 2011.

(51) Int. Cl.
*B21K 3/00* (2006.01)

(52) U.S. Cl.
USPC ..... 29/888.01; 29/407.09; 123/90.15; 123/90.16; 123/90.17

(58) Field of Classification Search
USPC ..... 29/23.51, 407.09, 888.01; 123/90.12, 123/90.15, 90.17, 90.31, 90.33, 90.34, 123/90.37; 464/1, 2, 160
See application file for complete search history.

(56) References Cited

U.S. PATENT DOCUMENTS

| | | | | |
|---|---|---|---|---|
| 7,363,897 | B2 | 4/2008 | Fischer et al. | |
| 7,614,370 | B2 | 11/2009 | Fischer et al. | |
| 7,669,566 | B2 | 3/2010 | Methley | |
| 2009/0266322 | A1 | 10/2009 | Fischer | |
| 2010/0031906 | A1 * | 2/2010 | Cuatt et al. | 123/90.17 |

OTHER PUBLICATIONS

T.H. Fischer, M. Sellnau, J. Pfeiffer, D. Gauthier, "Development and Optimization of Intermediate Lock Position Camshaft Phaser System"; SAE International, 2010-01-1192, Apr. 12, 2010.

* cited by examiner

*Primary Examiner* — Alexander P Taousakis
*Assistant Examiner* — Lee Holly
(74) *Attorney, Agent, or Firm* — Quinn Law Group, PLLC

(57) ABSTRACT

A method of setting lash in a cam phaser includes rotating a stator having a lobe in a first direction so that the lobe contacts a motion limiter pin disposed within a first hole in a rotor, causing the compression of a spring until a motion limiter lock pin enters a groove on the motion limiter pin and contacts a wall at one end of the groove. The rotor is then rotated in conjunction with the stator in the first direction until a rotor locking pin that is disposed within a second hole in the rotor engages a lock pin seat on a cover at one end of the seat. The rotor is then held in place while rotating the stator in a second direction so that there is a gap between the wall at one end of the groove and the motion limiter locking pin.

9 Claims, 4 Drawing Sheets

METHOD OF SETTING LASH IN A CAM PHASER

CROSS REFERENCE TO RELATED APPLICATIONS

This application claims the benefit of U.S. provisional patent application No. 61/498,898, filed Jun. 20, 2011, and which is hereby incorporated by reference in its entirety.

TECHNICAL FIELD

This invention relates to systems for selectively locking cam phasers.

BACKGROUND

Engine assemblies may include a cam phaser that is coupled to an engine camshaft to adjust timing of intake and/or exhaust valve opening events. Adjusting valve timing based on engine operating conditions may provide increased engine performance, such as increased power output, reduced fuel consumption, and/or reduced engine emissions. Increasing the extent that the camshaft may be advanced or retarded may provide for increased performance gains.

Typical vane cam phasing devices ("cam phasers") include a rotor and a stator, and have a positive stop position at the default or home position by using interference between the stator and the rotor to stop the rotational movement of the rotor at engine shut down. This allows a locking pin device to engage freely into its seat at engine shut-down to lock the rotor with respect to the stator. The cam phaser is prepared for engine start-up in this locked position. A mid-park cam phaser must lock at an intermediate position where this natural positive stop is not present, i.e., the rotor does not rest against the stator, and thus the lock pin may have difficulty engaging into its seat.

SUMMARY

A method of setting lash in a cam phaser is provided. According to one aspect of the disclosure, the method includes rotating a stator having a first lobe and a second lobe in a first direction so that the second lobe contacts a motion limiter pin disposed within a first hole in a rotor, thereby causing the compression of a motion limiter spring until a motion limiter lock pin enters a groove on the motion limiter pin and contacts a wall at one end of the groove. The method also includes rotating the rotor in conjunction with the stator in the first direction until a rotor locking pin that is disposed within a second hole in the rotor engages a lock pin seat on a cover at one end of the seat so that the cam phaser is at a zero lash position.

The method further includes holding the rotor in place while rotating the stator in a second direction in the amount required for a predetermined amount of lash so that there is a gap between the wall at one end of the groove and the motion limiter locking pin, and bolting the cover and stator together to maintain the predetermined amount of lash.

The above features and advantages and other features and advantages of the present invention are readily apparent from the following detailed description of the best modes for carrying out the invention when taken in connection with the accompanying drawings.

DETAILED DESCRIPTION

Figure 1:
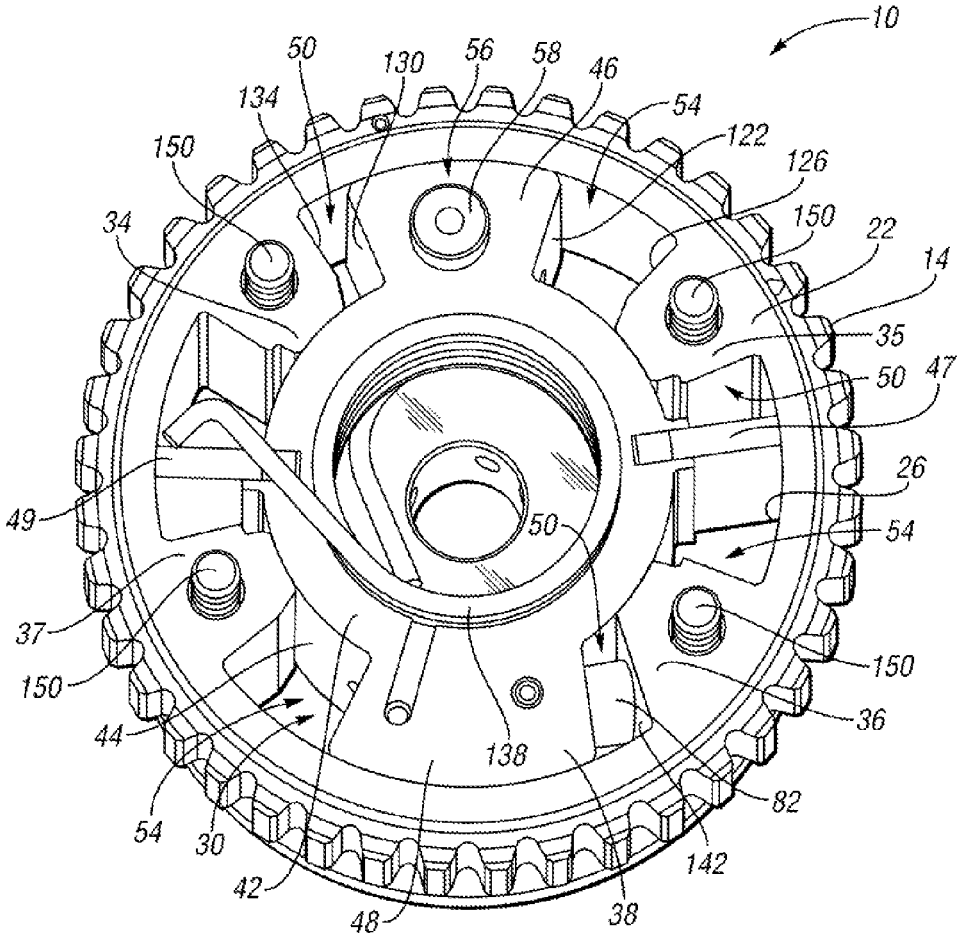
FIG. 1 is a schematic top view of a camshaft phaser.

Referring to FIG. 1, a camshaft phaser 10 is schematically depicted. The camshaft phaser 10 includes a pulley or sprocket 14 for engaging a belt or chain (not shown) operatively connected to an engine crankshaft (not shown). Accordingly, the sprocket 14 is drivable by the engine crankshaft via the chain for rotation about an axis 18. The camshaft phaser 10 also includes a stator 22, which is mounted with respect to the sprocket 14 for unitary rotation therewith about the axis 18. The stator 22 has an inner surface 26 that defines a chamber 30. The inner surface 26 is generally cylindrical, but includes a plurality of lobes 34, 35, 36, 37 that extend radially inward (toward the axis 18).

The camshaft phaser 10 also includes a rotor 38 disposed within the chamber 30. The rotor 38 includes a hub portion 42 having a generally cylindrical outer surface 44. A plurality of vanes 46, 47, 48, 49 extend outward from the hub portion 42. Each vane 46, 47, 48, 49 contacts a respective cylindrical portion of the inner surface 26 of the stator 22. Each of the vanes 46, 47, 48, 49 is disposed between two of the lobes 34, 35, 36, 37. Each lobe 34, 35, 36, 37 contacts a cylindrical portion of the outer surface 44 of the rotor 38. The lobes 34, 35, 36, 37 and the vanes 46, 47, 48, 49 define chambers 50, 54 therebetween. The chambers 50, 54 are selectively pressurized by hydraulic fluid to cause the rotor 38 to rotate about the axis 18 with respect to the stator 22 and thereby change the valve timing in the engine.

More specifically, the rotor 38 is mounted with respect to the camshaft (not shown). Accordingly, rotating the rotor 38 relative to the stator 22 in one direction will advance valve timing; rotating the rotor 38 relative to the stator 22 in the other direction will retard timing. The movement of the rotor 38 relative to the stator 22 is limited by interference between the lobes 34, 35, 36, 37 and the vanes 46, 47, 48, 49. For example, maximum valve timing advance may occur when vane 49 contacts lobe 34, and maximum valve timing retard may occur when vane 49 contacts lobe 37.

Figure 2:
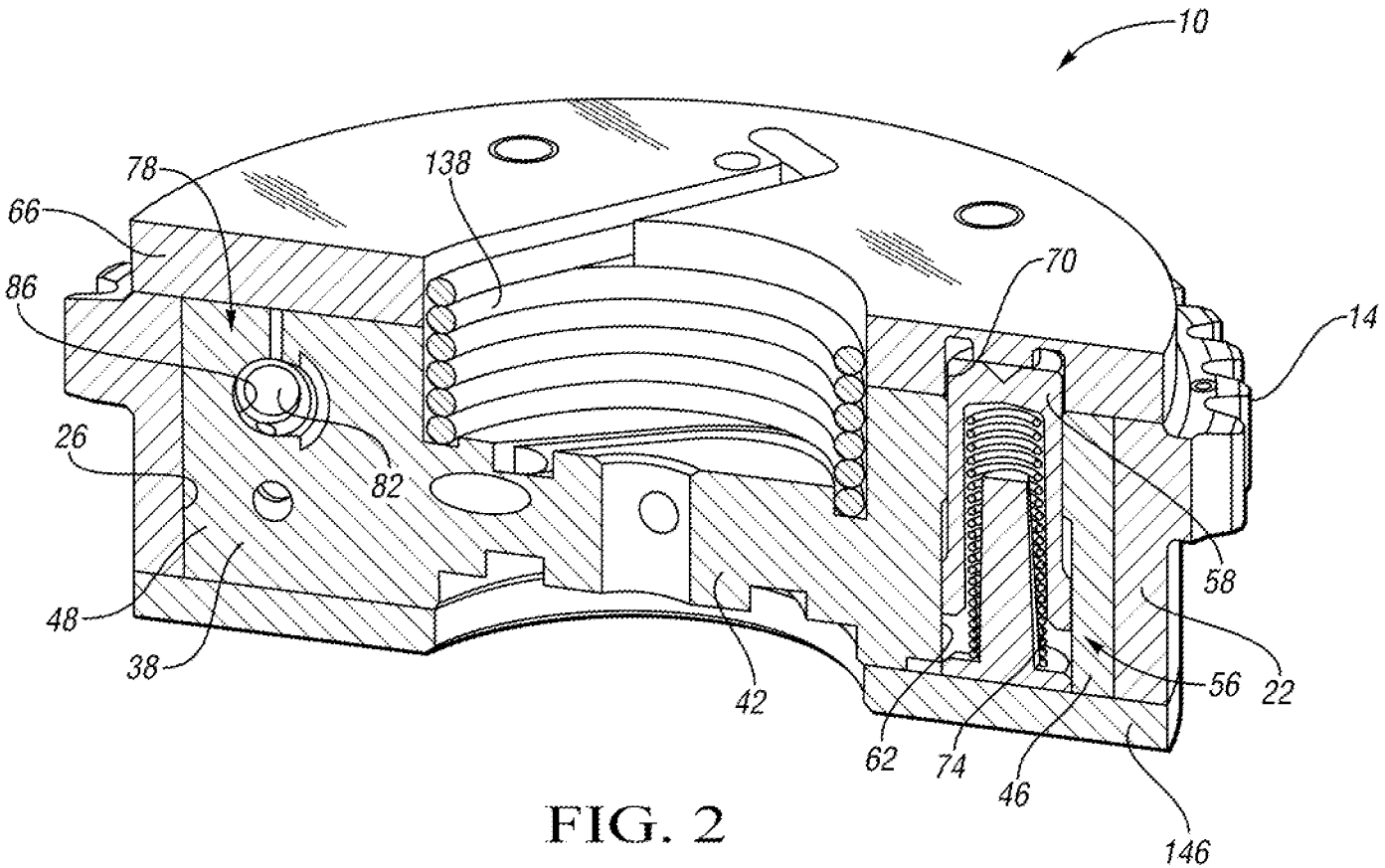
FIG. 2 is a schematic, sectional, side view of the camshaft phaser of FIG. 1.
Figure 3:
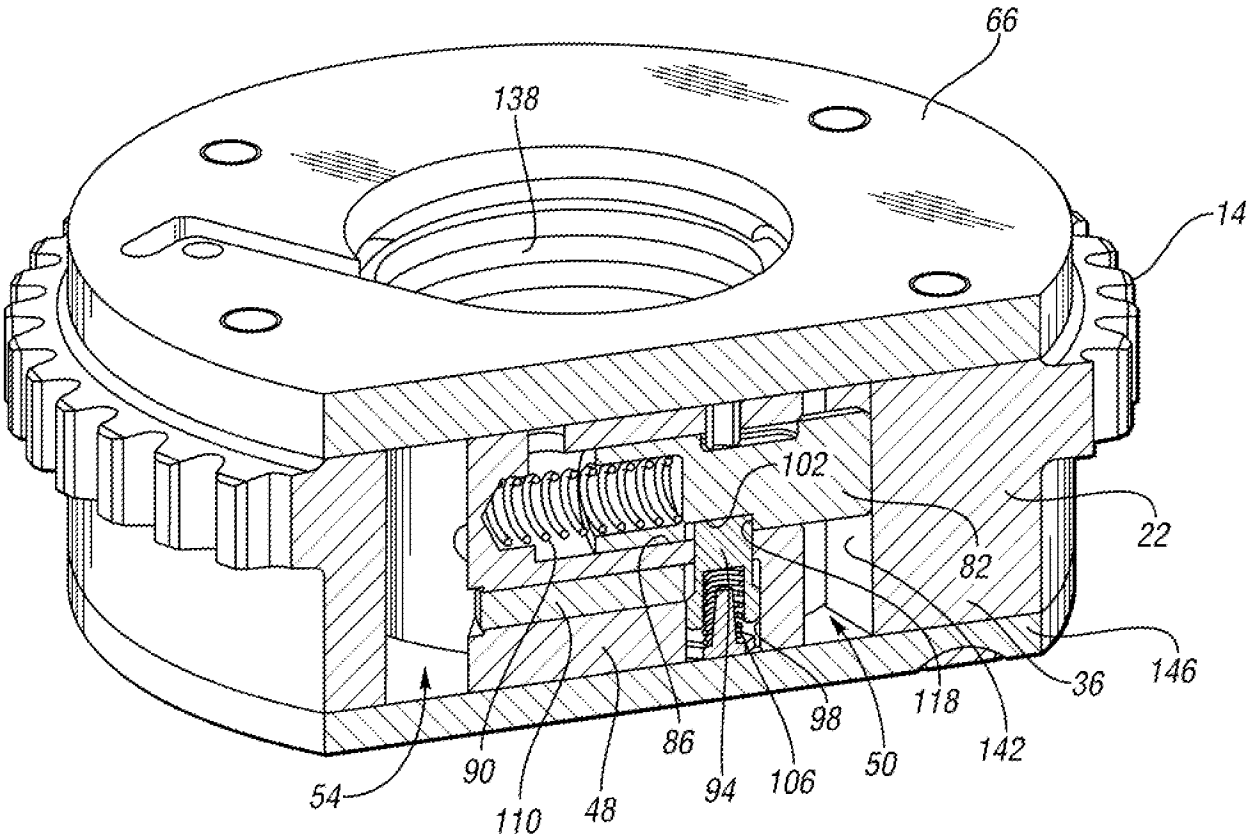
FIG. 3 is a schematic, partial cut-away side view of the camshaft phaser of FIG. 1.

As understood by those skilled in the art, it may be desirable to lock the rotor 38 relative to the stator 22 in a "mid park" position, as shown in FIG. 1, i.e., when the vanes 46, 47, 48, 49 are not in contact with any of the lobes 34, 35, 36, 37. Referring to FIG. 3, wherein like reference numbers refer to like components from FIGS. 1 and 2, a locking system 56 includes a rotor locking pin 58 that is at least partially disposed within a cylindrical bore 62 formed in vane 46. The bore 62 and the pin 58 are oriented and dimensioned such that movement of the pin 58 relative to the rotor 38 is substantially limited to linear translation parallel to the axis 18. The pin 58 is movable relative to the rotor 38 between an extended position, as shown in FIG. 2, and a retracted position. In the extended position, the pin 58 protrudes from the bore 62, and in the retracted position, the pin 58 does not protrude substantially from the bore 62.

A cover 66 is mounted with respect to the stator 22 to seal one end of the chamber 30. The cover 66 defines a concavity that functions as a seat 70 for the locking pin. The seat 70 is disposed on the cover 66 such that the seat 70 is aligned with the locking pin 58 when the rotor 38 is in the mid park position relative to the stator 22. When the rotor 38 is in the mid park position and the pin 58 is in the extended position, a portion of the pin 58 is in the seat 70, and another portion of the pin 58 is in the bore 62. Accordingly, the pin 58 locks the rotor 38 relative to the cover 66 and the stator 22. A spring 74 is disposed within the bore 62 and biases the pin 58 toward the extended position. The pin 58 is retractable by applying hydraulic pressure.

Figure 4:
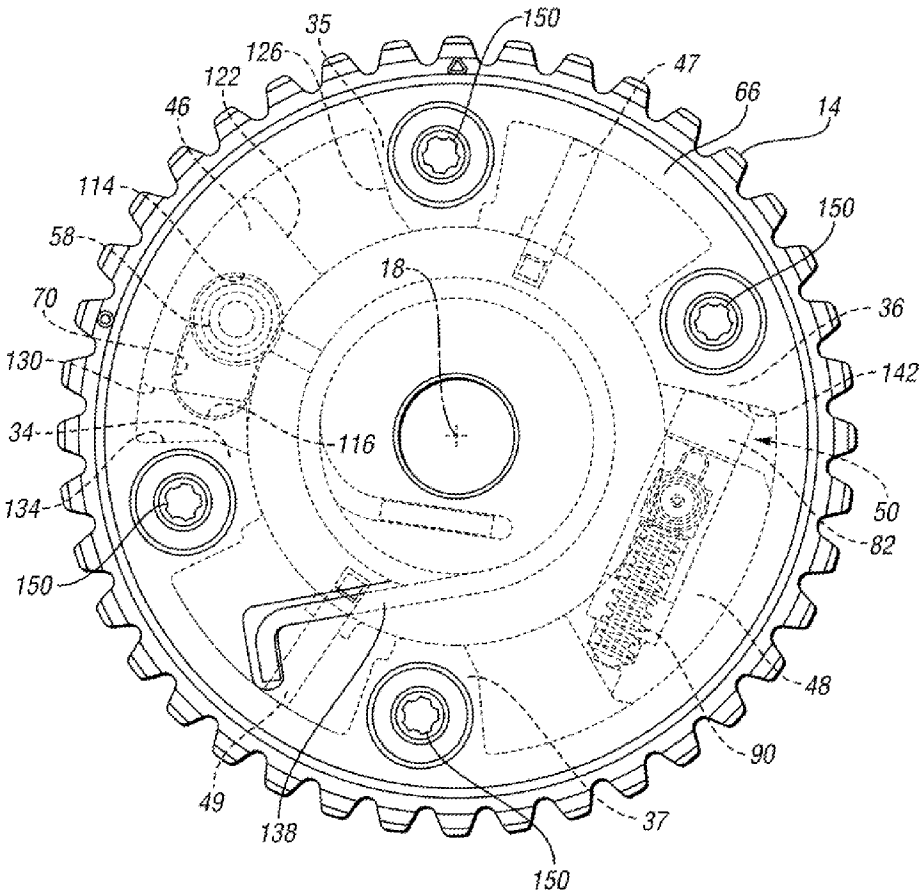
FIG. 4 is a schematic, partial cutaway, perspective view of the camshaft phaser of FIG. 1.

Unless the seat 70 is properly aligned with the pin 58, the pin 58 cannot enter the seat 70, and thus the rotor 38 will not lock. In order to facilitate the alignment and insertion of the pin 58 into the seat 70, the camshaft phaser 10 includes a motion limiter system 78. Referring to FIGS. 2-4, the motion limiter system 78 includes a motion limiter pin 82 that is disposed within a cylindrical bore 86 in vane 48 such that movement of the motion limiter pin 82 relative to the rotor 38 is substantially limited to linear translation. The pin 82 is selectively movable between a first motion limiter pin position, i.e., an extended position, as shown in FIGS. 3 and 4, and a second motion limiter pin position, i.e., a retracted position. In the extended position, the pin 82 protrudes outward from the bore 86 and into the chamber 50 that is formed between the vane 48 and the lobe 36; in the retracted position, the pin 82 does not extend substantially outside of the bore 86. A spring 90 is disposed within the bore 86 and urges the pin 82 toward its extended position.

A motion limiter locking pin 94 is disposed within another cylindrical bore 98 in vane 48. Locking pin 94 is substantially limited to linear translation perpendicular to the movement of motion limiter pin 82. Locking pin 94 is movable between an extended position, as shown in FIGS. 2-4, and a retracted position. The motion limiter pin 82 defines an annular groove 102; when the pin 94 is in the extended position, it is partially disposed within the groove 102, which locks the motion limiter pin 82 relative to the rotor 38. More specifically, in the embodiment depicted, the locking pin 94 interacts with the walls of the groove 102 to prevent translation of the motion limiter pin 82 when the locking pin 94 is in its extended position. When the locking pin 94 is in its retracted position, it is outside the groove 102, and thus the motion limiter pin 82 is free to translate within the bore 86. A spring 106 urges the pin 94 towards its extended position.

Upon engine start-up, engine oil pressure though passage 110 retracts the limiter locking pin 94 from the groove 102 of the motion limiter pin 82, which is followed by engine oil pressure retracting the locking pin 58, thereby allowing full movement of the rotor 38 within the phase range provided by the stator 22. While the rotor 38 is in any controlled position, the motion limiter spring 90 allows the motion limiter pin 82 to retract or extend depending on position of the rotor 38.

Upon engine shutdown oil pressure through the supply passage 110 is lost and the motion limiter locking pin spring 106 forces the limiter locking pin 94 to the locked position in the motion limiter pin groove 102. The motion limiter spring 90 forces the motion limiter pin 82 into position such that the limiter locking pin 94 engages into the motion limiter pin groove 102 and locks the motion limiter pin 82 in the extended position. The motion limiter pin 82 acts as a positive stop for the rotor 38 movement and aligns the phaser lock pin 58 over the lock pin seat 70 for proper engagement at shut down. More specifically, the pin 82 in its extended position protrudes from the vane 48 and contacts the lobe 36. The interaction of the pin 82 and the lobe 36 maintains the rotor 38 in the mid park position to facilitate the insertion of locking pin 58 into seat 70.

This design allows the use of additional retard authority during the cam phasing event by using a mid-park position as the default locking position at start-up. This additional retard authority stabilizes idle and increases fuel economy up to 1%. Without a safe locking mechanism that occurs 100% of the time, the use of the mid park position cam phaser is not possible and the additional fuel economy would not be achieved by this method. The motion limiter pin 82 functions as a positive stop when the rotor is in a mid-park or intermediate position. The lock pin 58 will then be allowed to engage into its seat 70 for proper engine start conditions. Additionally, the motion limiter locking pin 94 can be activated with oil pressure which is present in the typical vane cam phaser under normal conditions without additional oil supply porting and control hardware (oil control valve), although the design has flexibility to use various oil supply methods.

Thus, the camshaft phaser 10 includes a stator 22 having a first lobe 36 and a second lobe 37. A rotor 38 has a vane 48 disposed between the first lobe 36 and the second lobe 37 such that the rotor 38 and the stator 22 define a first chamber 54 between the first lobe 36 and the vane 48 and a second chamber 50 between the second lobe 37 and the vane 48. The rotor 38 defines a hole (i.e., bore 86) in the vane 48, and a motion limiter pin 82 is selectively movable between a first motion limiter pin position to a second motion limiter pin position. The motion limiter pin 82 extends farther into the first chamber 54 from the hole 86 when the motion limiter pin 82 is in the first motion limiter pin position than when the motion limiter pin is in the second motion limiter pin position.

The motion limiter pin 82 defines a concavity (i.e., groove 102), and the camshaft phaser 10 includes a motion limiter locking pin 94 configured to engage the concavity and thereby lock the motion limiter pin 82 in the first motion limiter pin position. Spring 90 urges the motion limiter pin 82 toward the first motion limiter pin position.

The rotor 38 defines a second hole (i.e. bore 62), and a rotor locking pin 58 is selectively movable with respect to the rotor 38 within the second hole. A cover 66 is mounted with respect to the stator 22 and defines a seat 70. The seat 70 is positioned such that the rotor locking pin 58 is aligned with the seat 70 when the motion limiter pin 82 is in the first motion limiter pin position and touches the first lobe 36.

Lash between the rotor locking pin and the seat facilitates engagement of the pin 58 with the seat 70 on engine shutdown and sets the default or engine start timing position of the cam. However, excessive lash may result in undesirable start-up noise. For engine start condition, the lock pin 58 must be seated in the lock pin seat 70 and there should be minimal lash that would create noise at start up. Referring specifically to FIG. 4, lash is set by the contact point of the lock pin 58 and the lock pin seat 70 (at one end 114 of the seat 70) in conjunction with the contact point of the motion limiter locking pin 94 and the groove 102 in the motion limiter pin 82 (at the wall 118 that forms one end of the groove 102). The seat 70 is elongated such that the distance between one end 114 of the seat 70 and the other end 116 of the seat 70 permits movement of the rotor locking pin 58 inside the seat 70, thereby allowing some rotation of the rotor 38 when the locking pin 58 is inside the seat 70.

Contact is made at only one of the points (i.e., wall 118 or end 114) maximum at any given time such that the rotor 38 can only rotate the amount of lash specified or set by the process. At engine start up, oil pressure acts on the face and/or shoulder of the rotor locking pin 58 which allows disengagement of the rotor locking pin 58 out of the lock pin seat 70 and allows movement of the rotor 38 to the desired advanced cam timing angle given by rotor face 122 and stator face 126.

Simultaneously, the oil pressure acts on the face and/or shoulder of the motion limiter locking pin 94 which allows disengagement of motion limiter locking pin 94 out of the groove 102 and allows movement of the rotor 38 to the desired retarded cam timing angle given by rotor face 130 and stator face 134.

On engine shut down, the locking pin 58 and the motion limiter locking pin 94 create lash for each other to allow for proper re-engagement. If the engine shutdown occurs while the rotor 38 is in the retarded cam timing position given by rotor face 130 and stator face 134, the lock pin 58 will fall into the lock pin seat 70 but will not be at the default or start-up position. The bias spring 138 and the motion limiter pin spring 90 will work against engine loads to move the rotor 38 back to the default position where the motion limiter locking pin 94 will then re-engage into the groove 102.

If engine shutdown occurs while the rotor 38 is in the advanced cam timing position given by rotor face 122 and stator face 126, the motion limiter locking pin 94 will engage into groove 102 which activates the positive stop given by the motion limiter locking pin 94 and motion limiter pin 82 where the motion limiter pin 82 contacts the stator face 142 and in turn provide lash for the re-engagement of lock pin 58 into lock pin seat 70 at the default or engine start position. If the motion limiter locking pin 94 does not re-engage into the groove 102 during the rotation of the rotor 38 towards the stator face 126, then the lock pin 58 will re-engage into the lock pin seat 70 which is then the same as the first condition discussed above for attaining the default position with the appropriate specified lash. The cover 66 which defines the lock pin seat 70 is locked in position.

To set the amount of lash in the cam phaser 10, the stator 22 is rotated such that the stator phase pad 142 contacts the motion limiter pin 82. The motion limiter pin spring 90 compresses until the motion limiter locking pin 94 contacts the groove 102 at location 118. The rotor 38 now rotates in conjunction with stator 22 until the lock pin 58 makes contact with lock pin seat 70 at location 114. The cam phaser 10 is now set at zero lash condition.

The rotor 38 is held in position while the stator 22 is rotated in the opposite direction in the amount that is required for nominal lash. The lash appears as a gap (not shown) between the motion limiter locking pin 94 and the motion limiter pin 82 at location 118. The rear cover 146 and four bolts 150 are loaded to the assembly while holding the position of stator 22. The four bolts 150 are tightened to an appropriate torque to hold the lash during service of the cam phaser 10.

Figure 5:
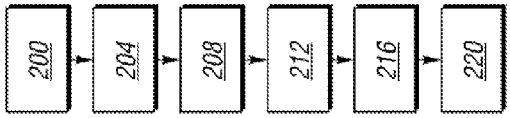
FIG. 5 is a flowchart depicting a method of setting lash in the camshaft phaser of FIGS. 1-4.

The method of setting lash is shown in FIG. 5. Referring to FIGS. 4-5, the method includes rotating the stator 22 in a first direction (clockwise as viewed in FIGS. 1 and 4) relative to the rotor 38 and the cover 66 about axis 18 such that the motion limiter pin 82 contacts the first lobe 36 (step 200). The method also includes, at step 204, rotating the stator 22 further in the first direction such that the motion limiter pin 82 moves relative to the rotor 38 inside hole 86 and compresses a first spring (i.e., motion limiter spring 90). The method further includes, at step 208, rotating the stator 22 further in the first direction such that the motion limiter locking pin 94 enters a concavity (i.e., groove 102) and contacts wall 118, which forms one end of the groove 102.

At step 212, the stator 22 is rotated further in the first direction until the rotor locking pin 58 contacts the first end 114 of the seat 70. It should be noted that, once the motion limiter locking pin 94 is in contact with the wall 118, rotation of the stator 22 in the first direction will cause rotation of the rotor 38 in the first direction. That is, force will be transferred from the lobe 36 of the stator 22 to the motion limiter pin 82; the wall 118 of the motion limiter pin 82 will transmit the force to the motion limiter locking pin 94, which in turn will transmit the force to the rotor 38. Thus, at step 212, rotating the stator 22 in the first direction also automatically includes rotating the rotor 38 and the rotor locking pin 58 in the first direction.

After step 212, the cam phaser 10 is at a zero-lash condition. That is, if the cover 66 is rigidly mounted to the stator 22, then interaction between the rotor locking pin 58 and the end 114 of the seat 70 will prevent rotation of the rotor 38 in the first direction, and interaction between the motion limiter locking pin 94 and wall 118 will prevent rotation of the rotor 38 in a second direction opposite the first direction (i.e., counterclockwise as viewed in FIGS. 1 and 4). More specifically, torque applied to the rotor 38 in the second direction will be transferred from the motion limiter locking pin 94 to the wall 118, which will transfer force through the motion limiter pin 82 to the stator 38. Thus, with the rotor locking pin 58 contacting the end 114 of the seat at the same time that the motion limiter locking pin 94 contacts wall 118, the lash is set to zero.

Lash is set at step 216 by rotating the stator 38 in the second direction (while maintaining the rotor 38 stationary relative to the stator 22) such that a gap having a predetermined size is between the motion limiter locking pin 94 and the wall 118. The cover 66 is then bolted to the stator 22 at step 220.

Thus, the lobes 34, 35, 36, 37 and the vanes 46, 47, 48, 49 are positioned to provide a first range of rotational motion of the rotor 38 with respect to the stator 22, e.g., vane 46 contacting lobe 34 limits the rotation of the rotor 38 in one direction, and vane 46 contacting lobe 35 limits the rotation of the rotor 38 in the other direction.

The seat 70 provides a second range of rotational motion of the rotor 38 with respect to the stator 22 when the rotor locking pin 58 is engaged with the seat 70. The seat 70 is an arcuate slot or groove, and when the pin 58 is disposed therein the rotor 38 may not rotate in the first direction once the pin 58 contacts end 114. Similarly, the rotor 38 may not rotate in the second direction once the pin 58 contacts the other end 116 of the seat 70. The second range of motion is narrower than the first range of motion.

The motion limiter system 78 is configured to selectively limit the rotation of the rotor 38 with respect to the stator 22 in the second direction; i.e., when the motion limiter locking pin 94 is engaged within groove 102, the motion limiter pin 82 contacts lobe 36 and prevents rotation of the rotor 38 in the second direction. The method of FIG. 5 adjusts the motion limiter system 78 such that, when the rotor locking pin 58 is engaged with the seat 70, the seat 70 and the motion limiter system 78 cooperate to provide a third range of rotational motion of the rotor 38 with respect to the stator 22 that is narrower than the second range of motion.

While the best modes for carrying out the invention have been described in detail, those familiar with the art to which this invention relates will recognize various alternative designs and embodiments for practicing the invention within the scope of the appended claims.

The invention claimed is:

1. A method of setting lash in a cam phaser comprising:

providing a cam phaser having a stator, a rotor, a cover, a rotor locking pin, and a motion limiter system; said stator having a first lobe and a second lobe; said rotor having a vane disposed between the first lobe and the second lobe; said rotor defining a first hole in the vane; said motion limiter system including a motion limiter pin having a wall at least partially having a concavity therein and selectively movable within the first hole, a first spring biasing the motion limiter pin in the direction of the second lobe, a motion limiter locking pin being selectively movable into the concavity, a second spring biasing the motion limiter locking pin toward the motion limiter pin; said cover comprising a seat for the rotor locking pin; and rotating the stator in a first direction relative to the rotor and the cover such that the motion limiter pin contacts the first lobe.

2. The method of claim 1, further comprising continuing to rotate the stator in the first direction such that the motion limiter pin moves relative to the rotor and compresses the first spring.

3. The method of claim 2, further comprising continuing to rotate the stator in the first direction such that the motion limiter locking pin enters the concavity and contacts the wall.

4. The method of claim 3, wherein the cover seat is characterized by a first end and a second end; and wherein the method further comprises continuing to rotate the stator in the first direction until the rotor locking pin contacts the first end of the seat.

5. The method of claim 4, further comprising rotating the stator in a second direction opposite the first direction such that a gap having a predetermined size is between the motion limiter locking pin and the wall.

6. The method of claim 5, further comprising a third spring biasing the rotor locking pin toward the cover.

7. The method of claim 5, wherein a second hole is disposed in the rotor; and wherein the rotor locking pin is at least partially disposed within the second hole.

8. The method of claim 5, wherein contact between the motion limiter locking pin and the wall prevents movement of the motion limiter pin with respect to the rotor in at least one direction.

9. The method of claim 5, further comprising connecting the cover to the stator.

* * * * *